US005318208A

United States Patent [19]

van der Wal

[11] Patent Number: 5,318,208

[45] Date of Patent: Jun. 7, 1994

[54] AEROSOL SPRAY CAN WITH ELECTRICAL ACTIVATING MEANS

[75] Inventor: Jurjen van der Wal, Costa Mesa, Calif.

[73] Assignee: Jurgen Van Der Wal Revocable Family Trust, Costa Mesa, Calif.

[21] Appl. No.: 7,916

[22] Filed: Jan. 22, 1993

[51] Int. Cl.[5] ..... B65D 83/14

[52] U.S. Cl. ..... 222/402.13; 222/474; 222/504; 239/373; 239/526; 251/129.21

[58] Field of Search ..... 222/323-324, 222/333, 402.2, 402.13, 402.15, 504, 474, 645, 649; 239/332, 373, 526; 16/110 R, 114 R; 251/129.21, 291; 200/61.86, 83 Q

[56] References Cited

U.S. PATENT DOCUMENTS

| | | | |
|---|---|---|---|
| 2,960,260 | 11/1960 | Kutik | 222/402.15 |
| 4,030,665 | 6/1977 | Koyama | 222/333 |
| 4,088,247 | 5/1978 | Hickman | 222/504 |
| 4,135,648 | 1/1979 | White | 222/402.2 |
| 4,154,375 | 5/1979 | Bippus | 239/332 |
| 4,187,959 | 2/1980 | Pelton | 222/333 |
| 4,393,993 | 7/1983 | Kille et al. | 222/333 |
| 4,401,240 | 8/1983 | Brack | 222/323 |

FOREIGN PATENT DOCUMENTS

| | | | |
|---|---|---|---|
| 2248888 | 4/1992 | United Kingdom | 222/504 |

*Primary Examiner*—Andres Kashnikow
*Assistant Examiner*—Philippe Derakshani
*Attorney, Agent, or Firm*—James G. O'Neill

[57] ABSTRACT

A combination aerosol spray can and operator system in which the operator is a handgrip releasably attached to a modified spray can. The handgrip is electrically operated from an electrical outlet and, and includes a manually activated trigger to control the application of alternating current to a solenoid operator secured to the handgrip and extending into an annular opening formed in the spray can. Upon partial actuation of the trigger, with the handgrip plugged in, the solenoid operator is actuated to open a first valve connected to the interior of the spray can, and upon further actuation of the trigger, a lever is operated to open a second valve to allow the contents of the spray can to be sprayed.

11 Claims, 2 Drawing Sheets

AEROSOL SPRAY CAN WITH ELECTRICAL ACTIVATING MEANS

BACKGROUND OF THE INVENTION

The present invention relates to an aerosol spray can which can spray only when it is energized by a specially equipped detachable handgrip with trigger, which by means of an electric cord is connected to a power supply.

PRIOR ART

Many types of handheld aerosol spray cans have been developed over the years, all of which require a compressed gas that is contained within the spray can together with the liquid that is to be sprayed. Most of these spray cans operate by depressing the spray nozzle of the can with a finger so that a springloaded valve within the spray can is opened and the liquid, propelled by a pressurized gas, can escape through a hollow connecting stem and the spray nozzle, of which the following are examples:

Ramella, U.S. Pat. No. 3,608,830 discloses a device with such a pressurized container, which represents a generally used embodyment of many handheld spray cans.

Frangos, U.S. Pat. No. 3,790,089, features an aerosol spray can with an internal valve construction that allows for the varying of droplet sizes.

Green, U.S. Pat. No. 3,915,390, depicts yet another spray can which provides metering means for the liquid that is being dispensed.

Sullivan, U.S. Pat. No. 4,978,938, contains a control valve as described in the above patents, but which also contains internally a second valve inlet with a closing member, with means for retaining said closing member at one of the liquid inlets, independent of the external forces acting on said valve.

While the prior art adequately describes the various types of spray cans that are in use today, a need has recently become apparent to prevent the indiscriminate use of aerosol spray cans, in particular those spray cans which are used for spraying paint.

Reference is hereby made to the virtually uncontrollable use of manually operated spray cans for the application of graffiti on buildings, walls and vehicles, all over the world. Graffiti is the method of choice for streetgangs to mark and define their respective territories, whereby the perpetrators have a complete disregard for the financial and aesthetic damage that is being done to property and to society as a whole, including the decent way of life to which most people aspire, not to speak of the great monetary expense of the efforts by the government and affected property owners to remove or at least cover the offending graffiti.

These efforts to control and eliminate this offending graffiti can now succeed by the universal adaption of the present invention, in which an electric cord, which needs to be plugged in, is required to make the spray can spray.

Because there are no plug-in sockets for electric cords in the outside walls of buildings, cars, freeways and highway signs, it becomes impossible to use the type of spray can that is described in the present invention in locations where no electric power is available, which is the main distinction of the present invention with respect to prior aerosol spray can art.

DESCRIPTION OF THE INVENTION

The present invention comprises a two-piece aerosol spray can system in which a specially equipped aerosol spray can is attached to a handheld spray can grip that has a manually activated trigger which controls the supply of an alternating electrical current. The aerosol spray can of subject spray system comprises, aside from its conventional content of a compressed gas and the liquid that is to be sprayed, a pair of opposing valves with a coil spring between them, whereby one of these valves is attached to a magnetizable plunger which can be shifted by an electrical solenoid that can be energized by pulling the trigger of the spray can handgrip of which the solenoid and trigger are integral parts.

After the solenoid has been energized, the spray can then can be made to spray by pulling the trigger a little deeper, so that the trigger will make contact with, and activate a lever mechanism which will then depress the sprayhead of the spray can, which will then open the other valve inside the spray can with the result that the way is then clear for the compressed gas to push the liquid out of the spray can, and start spraying.

The handgrip that holds the spray can has a quick spray ca attaching and releasing mechanism, so that anyone who wants to spray paint needs to acquire only one handgrip assembly, to which a new spray can can quickly be attached, and just as quickly can be detached when the spray can is empty, or when the operator wants to change colors.

The handgrip comprises a grip with a trigger, as is commonly used for electric hand drills, and it has an electric cord that requires plugging into an electric socket that supplies the standard alternating current, which is 110 Volt in the USA, and sometimes different in other countries. The trigger in the handgrip, when pulled by the operator, closes an electric circuit in a switch within the handgrip, so that an electric solenoid that is attached to the handgrip, is energized.

When the aerosol spray can is attached to the handgrip, the solenoid of the handgrip then surrounds the dual valve portion with its magnetizable plunger within the spray can. This plunger is thus spatially positioned in such a manner that it has become the plunger portion of an electric solenoid valve of which the solenoid portion is an integral part of the detachable handgrip. The spray can and the handgrip need to be mated before the electrical handgrip can be triggered to make the spray can spray, which is the basic principle of the present invention.

The recent advent of cordless drills might suggest a way of circumventing the required use of the electric cord with its alternating current by substituting the cord with a battery-operated handgrip, thus defeating the purpose of this invention. Recent research in stores that sell handtools has indicated that a 9.6 Volt cordless drill generates 110 Watt of power, and a 12.0 Volt cordless drill generates 140 Watt of power, and there is a 13.2 volt cordless drill with 155 Watt of power. This latter one has a handgrip of nearly 9 inches long, and it is reaching the point of becoming unwieldy for practical use. In order to prevent a cordless drill type handgrip from being modified by equipping it with a solenoid so that it might be used to spray with the plunger type spray can, all one needs to do is to put the energy that is required to lift the spray can plunger, against the pressure of the spray can spring, beyond the energy output of the battery operated handgrip. Using the 13.2

Volt, 155 Watt battery handgrip as an example, and say that twice the 155 Watt, that is 310 Watt, was required to make the plunger type spray can spray, then this 310 Watt could easily be supplied by the plugged-in electric cord.

In order for this invention to truly have an impact on the elimination of graffiti, it would require legislation that would ban the sale of non-electric spray cans, thereby providing for a say two year transition period, in the same manner as it was done when unleaded gasoline for use in automobiles was being banned. Besides, by simultaneously outlawing the manufacture of battery powered handgrips, the graffiti problem would quickly be solved, because it is nearly impossible for an amateur to manufacture such a device on his own.

For a more complete understanding of the present invention, reference is made to the following detailed description which should be read in conjunction with the accompanying drawings. Throughout the following description and drawings, identical reference numbers refer to the same part shown in multiple figures of the drawings.

DETAILED DESCRIPTION OF THE PREFERRED EMBODYMENT

Figure 1:
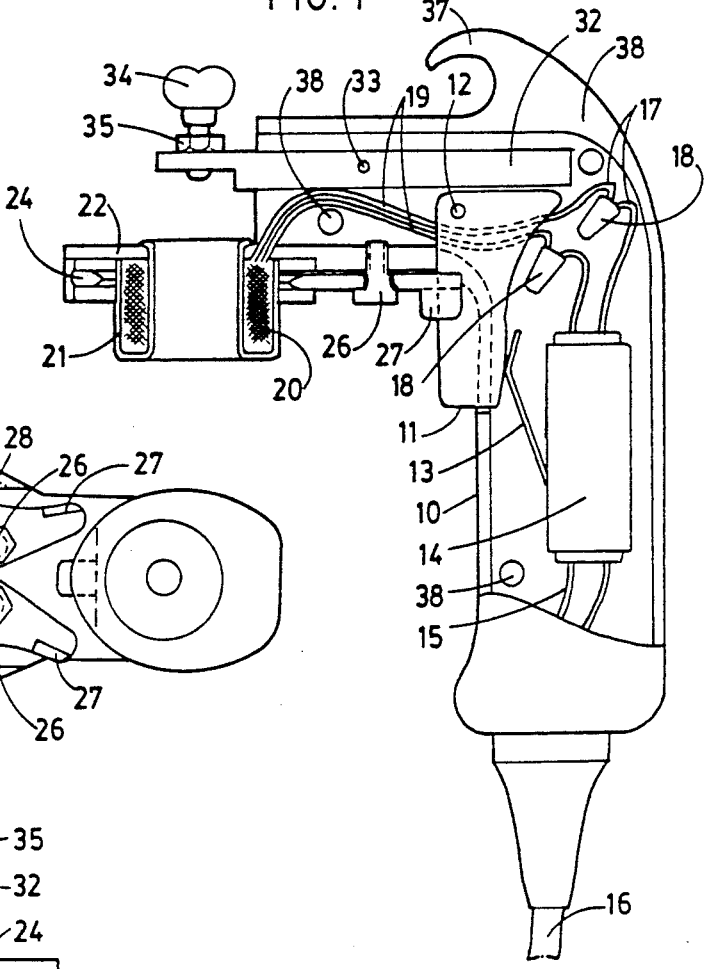
FIG. 1 is a cross section of the handgrip with its spray can locking mechanism, its electrical system with the on/off switch and solenoid, and its mechanical trigger and lever components.

Referring to FIG. 1, there shown is the spray can handgrip assembly of the present invention, which consists of handgrip 10 with trigger 11, which, when squeezed, pivots about pin 12, and in doing so, depresses switcharm 13 of electric switch 14. Said switch 14 is connected with a pair of electrical wires 15, which are a continuation of external cord 16 of the handgrip assembly, to an electrical plug (not shown) which may be plugged into an electric socket. Two electric wires 17 on the other side of electric switch 14 are connected by means of wirenuts 18 with electric leads 19 of electric solenoid 20, which is with its completely surrounding container 21 permanently attached to handgrip extension 22.

Figure 2:
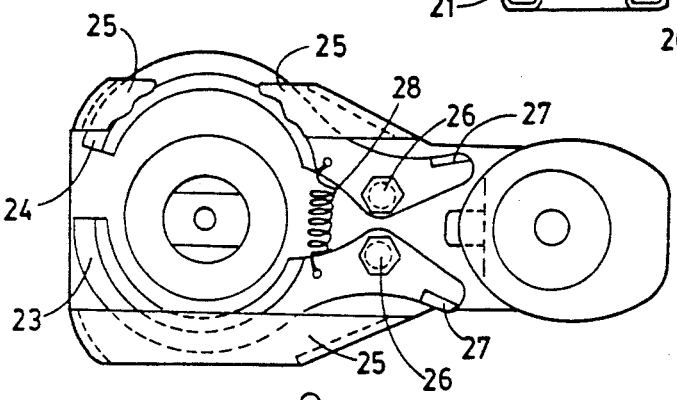
FIG. 2 is a bottom plan view of the handgrip assembly of FIG. 1, with its finger operated spray can locking and retainer blades.
Figure 3:
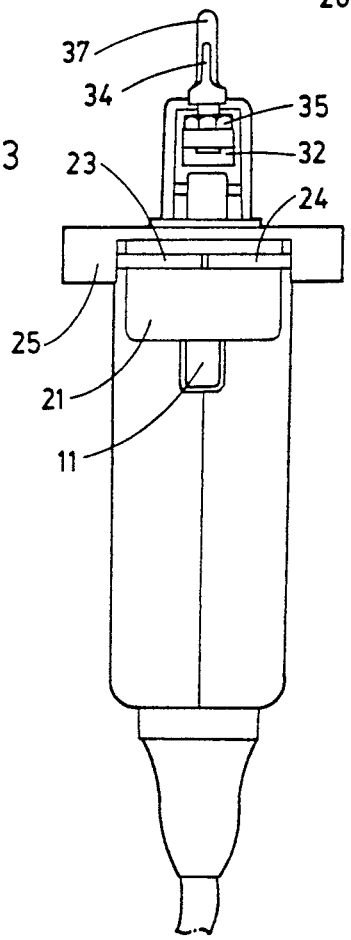
FIG. 3 is a front view of FIG. 1, as seen from the spray can side.

The entire handgrip assembly of FIG. 1 has a basically left-right symmetrical configuration, which is apparent in FIG. 3, and this also applies to retainer and locking blades 23 and 24, as shown in FIG. 2. These locking blades are kept aligned by means of retainer guides 25 when these blades are pivoting about identical opposite pins 26. The upper guide 25 on the drawing is shown partly cut away for clarity. Each of the ends of these blades have near the handgrip an extended bendover lip 27 which facilitates the squeezing of these lips by the thumb and index finger of the operators hand, while the other three remaining fingers of the same hand are holding on to the handgrip assembly handle below the trigger. The other hand of the operator can then with his/her other hand take the spray can of FIG. 4 and insert it straight upwards into the electrical solenoid container 21 as far as it will go, after which squeeze lips 27 can be let go by the operator, whereupon spring 28 will snap the locking blades 23 and 24 towards one another, so that they will enter the circular groove 29 below collar 30 of spray can 31. Having come from opposite sides, said locking blades now surround the perimeter of the collar of the spray can for about 85 percent, and the spray can is now firmly attached to the handgrip assembly of FIG. 1. In FIG. 2 locking blade 23 is shown in the locking position, and locking blade 24 is shown in the opened position.

The handgrip assembly of FIG. 1 further contains a lever 32 which is engaged by trigger 11 after electrical solenoid 20 already has been energized. Said lever 32 pivots about pin 33, and at the end of the lever, near the solenoid, the lever has a wingbolt 34 with locknut 35, so that clearance adjustments can be made with respect to sprayhead 36 of spray can 31. For convenience this handgrip assembly has a hook 37 which permits the suspending of the entire combined handgrip-with-permits spray can-assembly from a horizontal wire or nail when it is not being used. Circles 38 indicate the locations of the screws which assemble the left and right halves of the handgrip into a single and complete entity.

Figure 4:
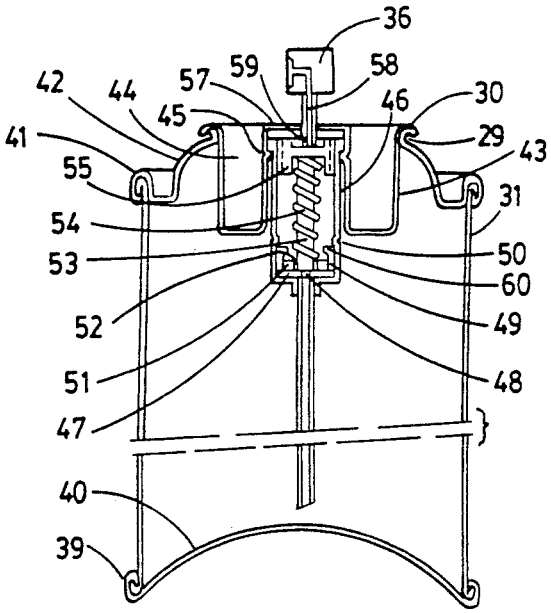
FIG. 4 is a cross section of the spray can, which can be locked into the handgrip assembly of FIG. 1 by moving it straight upward from its position where it is shown in relation to FIG. 1

The round aerosol spray can 31 of FIG. 4 has a conventional rolled connection 39 to its bottom 40, and a similar rolled connection 41 to its curved top 42. Collar 30 is also in this conventional manner rolled together with central top section 43, which is actually a hollow donut-like ring 44, which is made to receive inserted solenoid container 21 when the spray can is attached to the handgrip assembly of FIG. 1 after locking blades 23 and 24 have closed under said collar 30.

The inner wall of hollow ring 44 has locked firmly in place, by means of some indentations 45 towards its center, a centrally located dual valve containment cylinder 46 within itself. Said cylinder 46 has at its bottom a tube connected to it which reaches nearly to bottom 40 of spray can 31. The spray can is shown in a cut and shortened manner due to drawing space limitations.

The inside of central cylinder has at its bottom an elastomeric valve seat 47 with central opening 48. This valve seat is kept in place by bushing 49, which in turn is kept in place by pinched portions 50 of central cylinder 46. Valve body 51 has near its perimeter fluid canals 52, and said valve 51 is an integral part of central valve plunger 53, which is surrounded by coil spring 54. The upper end of said coil spring nests centrally within valve 55 which has a fluted perimeter 56 to permit fluid flow through the valve opening when this valve is pressed open. This valve seats on elastomeric seal 57, and the valve is connected by hollow stem 58 to sprayhead 36. A small opening 59 in the side of this hollow stem permits the fluid that is to be sprayed to pass from within central cylinder 46 to sprayhead 36.

Figure 5:
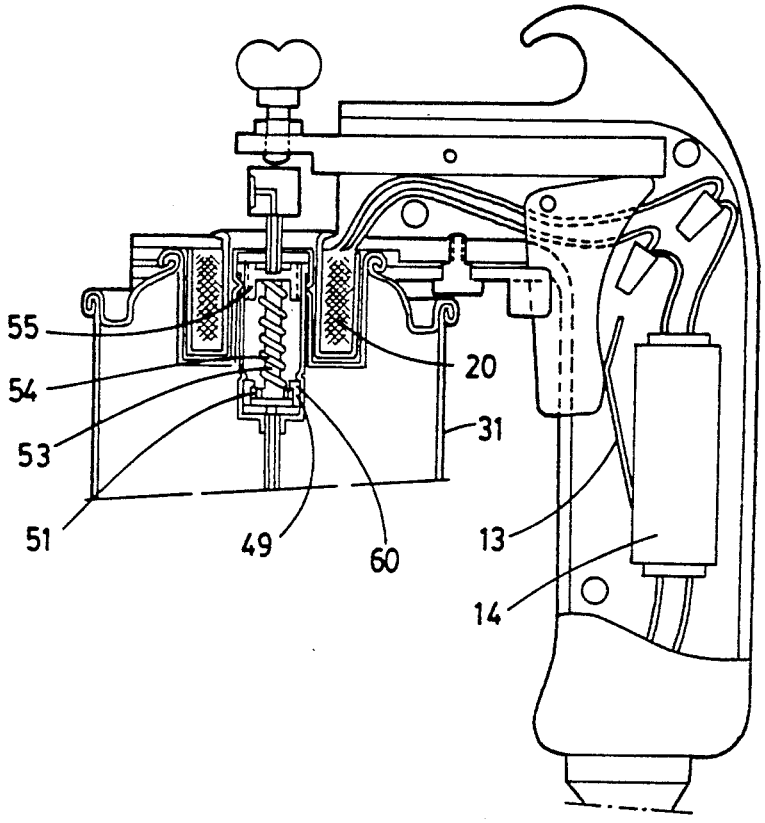
FIG. 5 shows the spray can of FIG. 4 as it has mated with the spray can of FIG. 1, whereby the partly pulled trigger has energized the solenoid of the handgrip, which caused the spray can's plunger and its attached lower valve to be pulled up into the solenoid, thus having opened the lower valve within the spray can.

FIG. 5 shows partly squeezed trigger 11 depressing switch arm 13 of electric switch 14, and energizing electric solenoid 20 so that its generated magnetic field has drawn magnetizable plunger 53 into the solenoid, thus opening lower valve 51, against the restraint of coil spring 54. The lift of plunger 53 and its attached valve 51 is limited by inward collar 60 of bushing 49, so as to prevent plunger 53 from moving all the way up against top valve 55, which in that case could not be opened against the large electromagnetic force that the energized solenoid exerts on the plunger.

For operating efficiency it is useful to choose for the plunger's material an iron alloy that is easily attracted by the magnetic field of the energized solenoid, while simultaneously one should make all other components of the spray can, as well as the components of the spray can handgrip assembly, of materials that are indifferent to the presence of a magnetic field, such as stainless steels and plastics. This would preserve the available magnetic field for the sole benefit of the plunger, thus maximizing the operating efficiency of the solenoid/-plunger combination.

Figure 6:
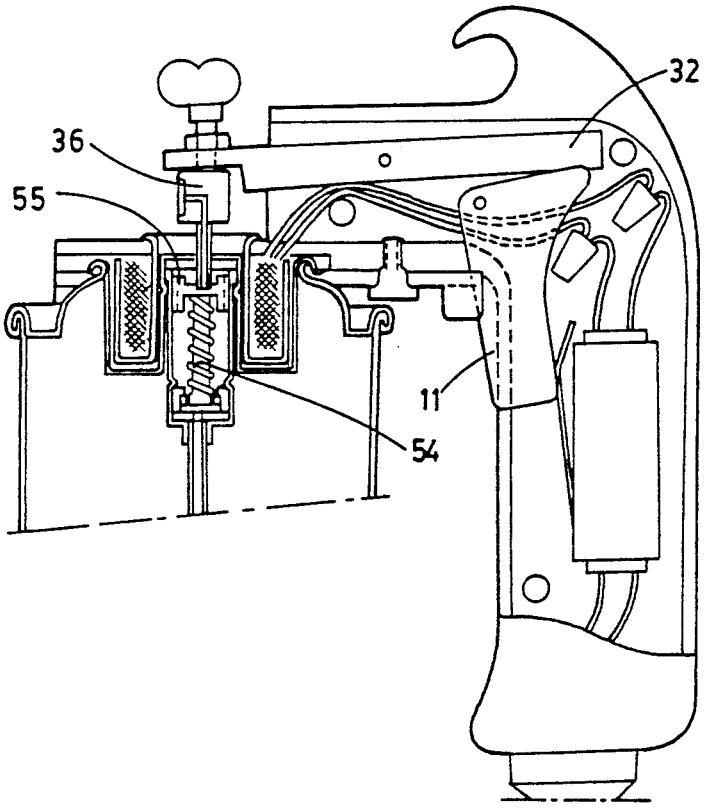
FIG. 6 shows the spray can as described in FIG. 5, except that the trigger of the handgrip is now completely pulled in, which has caused the built-in lever mechanism of the handgrip of FIG. 1 to depress and open the upper valve within the spray can, so that now the liquid within the spray can, which is pressurized by a compressed gas, can escape and spray.

FIG. 6 shows trigger 11 in the fully depressed position, thus keeping the solenoid energized, but in this mode the force of the trigger finger of the operator has now pivoted the upper part of the trigger hard against the end of lever 32, which now has pivoted, and said lever's other end has thus made contact with, and depressed spray can spray head 36 and opened top valve 55 within the spray can against the pressure of coil spring 54. The spray can is now spraying, the liquid is being propelled by the compressed gas that is stored within the spray can above the liquid.

Release of trigger 11 will return microswitch 14 and lever 32 to their original non-operating positions, valves 51 and 55 will then be closed again by the pressure of expending coil spring 54, the spraying will stop, and the spray can has returned to its non-operating mode.

The foregoing has been offered for illustrative purposes only, and is not intended to limit the scope of the invention of this application, which is as defined in the claim below.

That which is claimed is:

1. A combination handgrip assembly and aerosol spray can, in which said handgrip assembly is removable from said spray can and includes a trigger means which may be activated by a finger of an operator's hand that holds said handgrip assembly, the improvement comprising:

an integral electric switch, located within said handgrip assembly, said integral electric switch having an external on/off switch arm, which, when activated by said trigger means, as it is squeezed by the finger of the operator's hand, closes an electric circuit; and a lever means pivotally mounted in said handgrip assembly, which, upon further activation of said trigger means by said finger of the operator'hand, will be actuated to contact and depress a sprayhead assembly of said aerosol spray can, to allow said aerosol spray can to spray.

2. The combination handgrip assembly and aerosol spray can of claim 1, further including a space between said lever means said sprayhead assembly and an adjustment means secured to said lever means for adjusting the space between said lever means said sprayhead assembly.

3. The combination handgrip assembly and aerosol spray can of claim 2 wherein said adjustment means is an adjustment nut and a lockwasher carried by said lever means.

4. The combination handgrip assembly and aerosol spray can of claim 1, further including a pair of pivotable spring-tensioned locking blades engagable with a collar portion formed on said aerosol spray to releasably lock said handgrip assembly to said aerosol spray can; said pair of pivotable spring-tensioned locking blades being aligned by stationary guides supporting said pair of pivotable spring-tensioned locking blades.

5. The combination handgrip assembly and aerosol spray can of claim 4, wherein said aerosol spray can has a generally cylindrical shape with a top portion including said collar portion and a sealed and separate space formed within aerosol said spray can with a sprayhead having an internal valve means secured to said aerosol spray can inside of said sealed and separate space and an annular cavity formed in said aerosol spray can surrounding said sealed and separate space; and wherein an electric solenoid secured to said handgrip assembly is inserted into said annular cavity when said handgrip assembly and said aerosol spray can are secured together.

6. A combination handgrip assembly and aerosol spray can, in which said handgrip assembly is removable from said spray can and includes a trigger means which may be activated by a finger of an operator's hand that holds said handgrip assembly, the improvement comprising:

said aerosol spray can having a generally cylindrical shape with a top portion including a rolled collar having a recessed ring formed below said rolled collar suitable for receiving locking blades pivotably mounted to said handgrip assembly to secure said aerosol spray can and said handgrip assembly together;

a sealed and separate space formed within aerosol said spray can;

a sprayhead having an internal valve means secured to said aerosol spray can inside of said sealed and separate space;

an annular cavity formed in said aerosol spray can surrounding said sealed and separate space; and an electric solenoid secured to said handgrip assembly and inserted into said annular cavity.

7. A combination handgrip assembly and aerosol spray can, in which said handgrip assembly is removable from said spray can and includes a trigger means which may be activated by a finger of an operator's hand that holds said handgrip assembly, the improvement comprising:

said aerosol spray can having substantially cylindrical top and bottom portions, with an annular cavity formed in the top portion;

an electric solenoid integrally secured to said handgrip assembly and insertable into said annular cavity;

a pair of pivotable spring-tensioned locking blades engagable with a collar portion at said top portion of said aerosol spray can to releasably lock said handgrip assembly to said aerosol spray can;

a connect/disconnect feature whereby an operator having two hands may use one hand to insert and remove said cylindrical top portion of said aerosol spray can into and out of said annular cavity, while the operator's other hand may grip said handgrip and open and close said pair of locking blades to lock and unlock said aerosol spray can with respect to said handgrip.

8. The combination handgrip assembly and aerosol spray can of claim 7, further including a valve activated by a plunger in said cylindrical top portion of said aerosol spray can, which valve and plunger are only capable of being activate when said handgrip is secured to said aerosol spray can with said electric solenoid inserted into said annular cavity.

9. The combination handgrip assembly and aerosol spray can of claim 8, wherein said plunger is made from a material which is attached by a magnetic field so as to actuate said valve upon creation of the magnetic field when said solenoid is activated by said trigger.

10. The combination handgrip assembly and aerosol spray can of claim 9, wherein said handgrip and said aerosol spray can are specifically shaped, and fabricated from materials which will provide the least interference possible with the interaction of said magnetic field with said plunger.

11. The combination handgrip assembly and aerosol spray can of claim 7, further including an electric circuit connected to said electric solenoid having means therein which will only allow said solenoid to be operated by alternating electrical current.

* * * * *